US007213514B2

(12) United States Patent
Dettinger et al.

(10) Patent No.: US 7,213,514 B2
(45) Date of Patent: May 8, 2007

(54) EXTENSION ARM FOR A SHEET-PROCESSING PRINTING MACHINE

(75) Inventors: Dieterich Dettinger, Heusenstamm (DE); Arno Gartner, Karlsteing (DE); Erich Lang, Karlstein (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 303 days.

(21) Appl. No.: 10/415,871

(22) PCT Filed: Oct. 23, 2001

(86) PCT No.: PCT/EP01/12202

§ 371 (c)(1),
(2), (4) Date: Nov. 1, 2004

(87) PCT Pub. No.: WO02/36472

PCT Pub. Date: May 10, 2002

(65) Prior Publication Data

US 2005/0061174 A1 Mar. 24, 2005

(30) Foreign Application Priority Data

Nov. 2, 2000 (DE) ..... 200 18 691 U

(51) Int. Cl.
*B41F 13/56* (2006.01)

(52) U.S. Cl. ..... 101/240; 101/232; 271/231; 271/214; 271/217

(58) Field of Classification Search ..... 271/8.1, 271/290, 66, 198, 201, 213, 214, 217; 101/232, 101/240

See application file for complete search history.

(56) References Cited

U.S. PATENT DOCUMENTS

| | | | | |
|---|---|---|---|---|
| 4,043,458 | A * | 8/1977 | Schott, Jr. | 414/789 |
| 5,211,090 | A * | 5/1993 | Rathert | 83/24 |
| 5,322,271 | A * | 6/1994 | Ganter | 271/214 |
| 5,349,904 | A * | 9/1994 | Ganter | 101/227 |
| 5,713,283 | A | 2/1998 | Eltner et al. | |
| 6,536,497 | B2 * | 3/2003 | Cook | 156/362 |

FOREIGN PATENT DOCUMENTS

| | | |
|---|---|---|
| DE | 27 09 103 A1 | 9/1977 |
| DE | 195 16 071 A1 | 11/1996 |
| DE | 196 04 562 A1 | 8/1997 |
| DE | 198 19 491 C1 | 9/1999 |
| DE | 199 10 280 A1 | 9/1999 |
| EP | 0 974 543 A1 | 1/2000 |

* cited by examiner

*Primary Examiner*—Ren Yan
*Assistant Examiner*—Kevin D. Williams
(74) *Attorney, Agent, or Firm*—Leydig, Voit & Mayer, Ltd.

(57) ABSTRACT

A sheet delivery mechanism for a sheet-fed printing machine which is adapted to reduce changes in the position of sheet material in a stack during a stack changeover operation and which facilitates the formation of a stack with properly aligned edges. The sheet-delivery mechanism includes at least one length adjustable edge guide 16 supported between a stack support plate 14 and a cross element 15 which can be detachably connected to the frame of the sheet delivery mechanism.

16 Claims, 3 Drawing Sheets

EXTENSION ARM FOR A SHEET-PROCESSING PRINTING MACHINE

FIELD OF THE INVENTION

The invention relates to a sheet delivery mechanisms for sheet-fed printing machines, and more particularly, to a sheet delivery mechanism for changing over from one stack to another without interrupting operation of the printing machine.

BACKGROUND OF THE INVENTION

DE 195 16 071 A1 shows a sheet-fed printing machine having a sheet delivery mechanism for changing over from one stack to another while permitting continuous sheet feeding. In this case, a separating element is used which includes a shaft arranged outside the stacking region and one or more wedges, wherein the separating element provides a triangular space required for inserting the stack rake. The separating element lies on the top sheet of the main stack in the region of the front edge. The additional sheets received are simultaneously placed on the auxiliary stack now being formed above the separating element. The sheets accumulated above the separating element are released when the separating element is turned about the shaft and follows the main stack being lowered, wherein the separating element is subsequently pivoted out of the stacking region. This device can only be used with stack rakes because the wedges must contact the upper edge of the main stack through the intermediate spaces of the stack rake.

A sheet delivery mechanism with a device for changing over from one stack to another in a sheet-fed printing machine with continuous sheet feeding is also is known from DE 198 19 491 C1. This device is arranged upstream of a delivery stack (i.e. first stacking system) and functions as a switch, wherein the device selectively deposits the sheets on the delivery stack (first stacking system) or on a second stacking system arranged upstream of the first stacking system. During a nonstop stack changing mode, for example, the switch is activated in such a way that the sheets can be deposited on the second stacking system. In the meantime, the main stack of the first stacking system, for example, can be lowered and transported away from the sheet delivery mechanism, wherein a new stack board or stack rake is previously inserted, and wherein the sheets that were transported to the second stacking system are now fed to the delivery stack (first stacking system). The stack of the second stacking system can be exchanged in the meantime.

When changing a stack, however, it is disadvantageous that sheet material which is properly aligned change its position in the stack when the stack is changed. The lowering movement and/or air enclosed between the sheets and the resulting reduction in static friction, particularly in the upper region of the stack can cause the sheets to change their position in the stack.

OBJECTS AND SUMARY OF THE INVENTION

It is an object of the present invention to provide a sheet delivery mechanism which prevents movement and misalignment of sheets in a stack during a stack changeover.

In carrying out the invention, a sheet delivery mechanism is provided that has an edge guiding device of variable length located against at least one edge of the sheet material being stacked, for example, the front edge, wherein said edge guiding device is arranged between a vertically movable stack support plate and a crossarm that preferably is removably mounted on the frame. This edge guiding device guides the sheet material into predetermined stacked position and, in particular, guides the sheet material when the main stack is lowered. This prevents the material being printed from changing its position in the stack, for example, by shifting, and the proper alignment of the stack edges achieved during the sheet delivery is preserved when the stack is lowered.

It also is advantageous if the length of the edge guiding device is variable during the vertical upward and downward movement of the stack. Independent of stack size, this ensures a continuous guidance in the region of one edge, for example, the front edge, of the stacked sheet material when a stack is changed, particularly during the lowering movement.

It also is advantageous if the edge guiding device is arranged a short distance from the edge of the sheet material forming the stack. This makes it possible to prevent friction between one edge of the sheet material and the edge guiding device during relative movement upon lowering of the stack. This friction could negatively influence the desired position of the sheet material in the stack.

It further is advantageous if the edge guiding device is arranged on a crossarm, and if the crossarm is removably connected to the frame of the sheet delivery mechanism. The edge guiding device also preferably is removably or separably connected to the crossarm. This makes it possible to perform the stacking operation without an edge guiding device when additional free space is required.

According to another embodiment, it is advantageous if the removable crossarm can be detached from the frame of the sheet delivery mechanism, preferably in a manual fashion, and detachably fixed, for example, in a parked or stored position on the stack support plate together with the edge guiding device.

The sheet delivery mechanism according to the invention can be universally used, for example, in the non-stop stack change mode, or in a packaging mode in which partial stacks are generated that contain a certain quantity of sheet material.

It will be appreciated that the invention is not limited to the use of only one edge guiding device. On the contrary, it also would be possible to arrange several edge guiding devices according to the invention on given edges of the stack.

Other objects and advantages of the invention will become apparent upon reading the following detailed description and upon reference to the drawings, in which:

Figure 1:
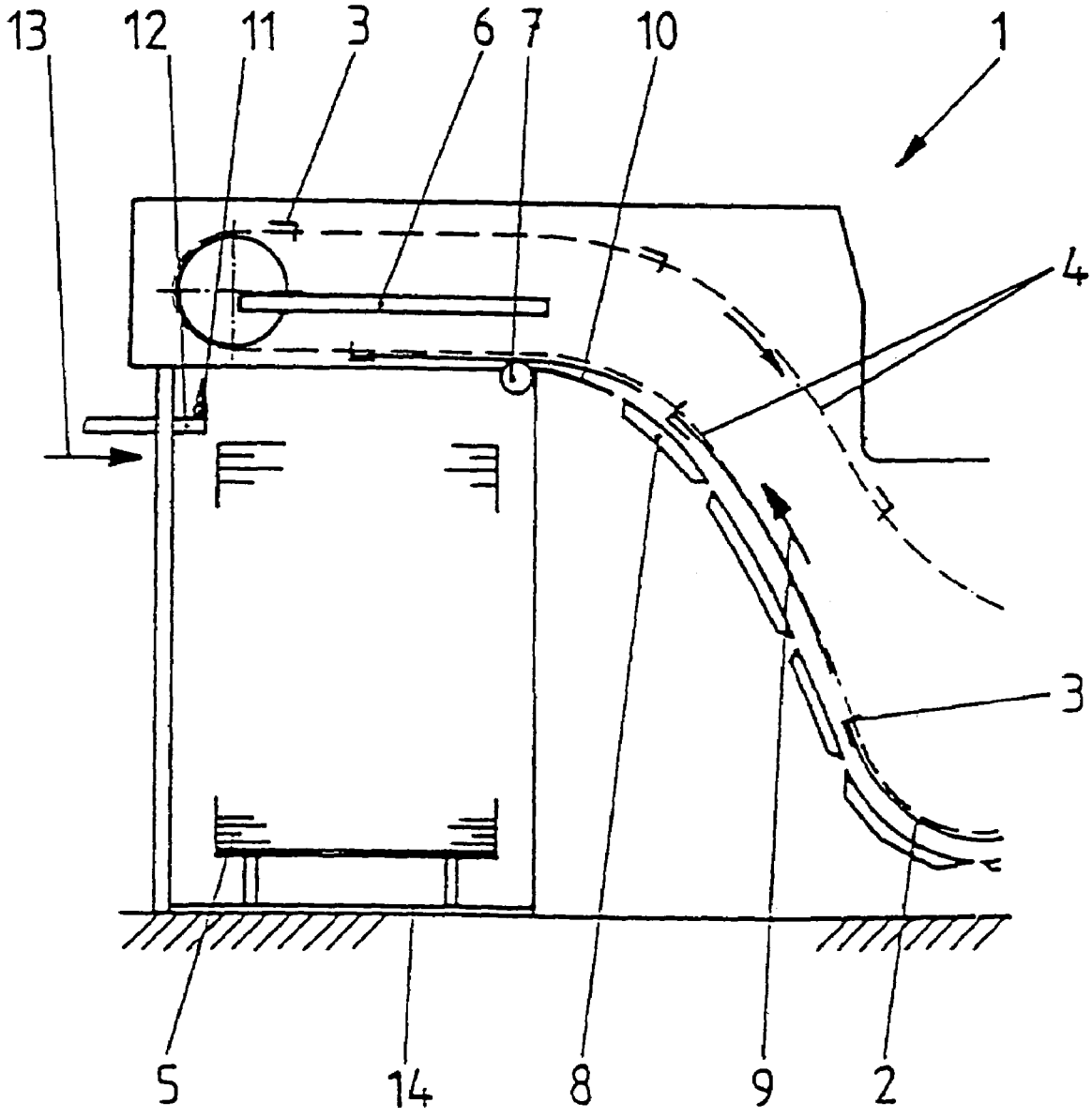
FIG. 1 is a partial schematic of the downstream end of a sheet-feed printing machine having a sheet delivery mechanism in accordance with the present invention.
Figure 2:
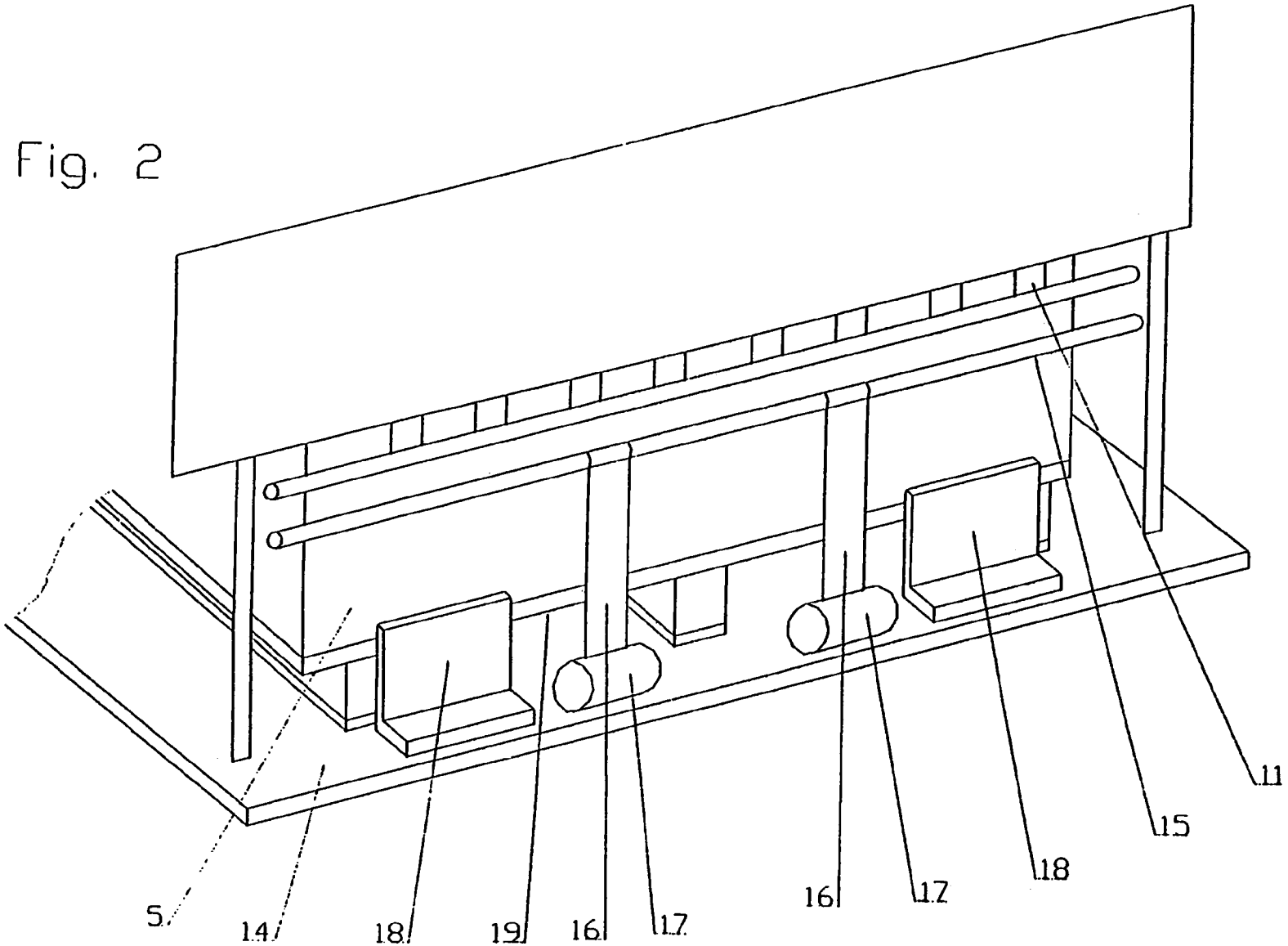
FIG. 2 is a front perspective of the sheet delivery mechanism of the printing machine shown in FIG. 1.
Figure 3:
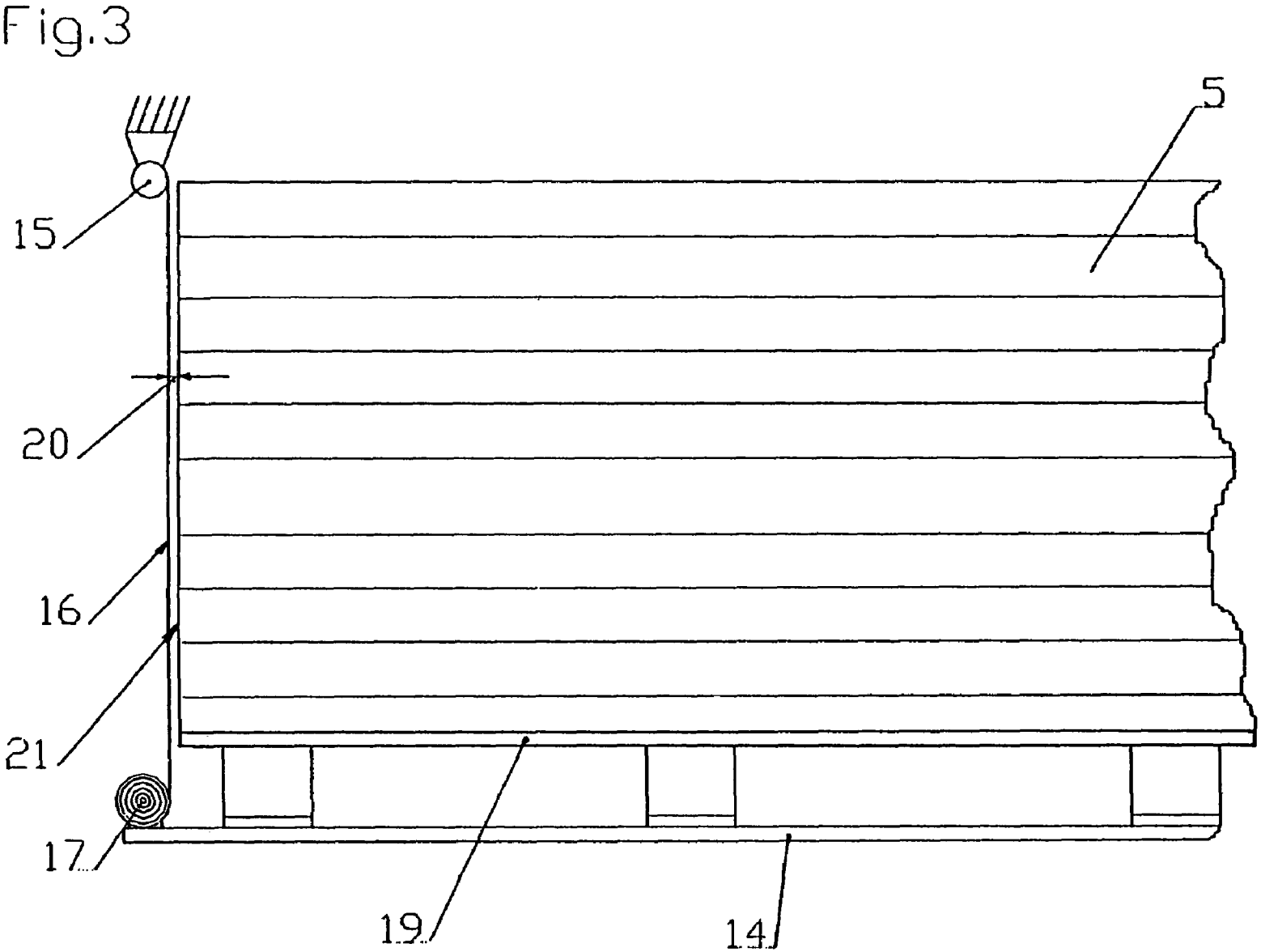
FIG. 3 is a side elevational view of the sheet delivery mechanism shown in FIG. 2.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to FIG. 1 of the drawings, there is a shown an illustrative sheet delivery mechanism 1 embodying the present invention which is located at the downstream end of a conventional sheet-fed printing machine for receiving and stacking the printed sheet material. The sheet delivery mechanism includes a revolving conveyor system 4 with grippers 3 arranged thereon, wherein the sheet delivery mechanism 1 grippers feed the sheet material 2 arriving from an upstream printing station or converting station to a delivery stack 5. During this process, the sheet material 2 is guided along stationary sheet guiding elements 8 and sheet guiding elements 10 that can be adjusted depending on the format and the print image. The sheet guiding elements 8, 10 preferably can be selectively controlled and operated by means of blasting air and suction air. A pneumatic system 6 for assisting in depositing the arriving sheet material 2 on the delivery stack 5 is arranged above the delivery stack 5.

The sheet material 2 traveling in the transport direction 9 is decelerated by a sheet decelerating device 7 in a conventional manner and deposited onto the delivery stack 5 such that its front edges contact limit stops 11. Pivoted guides which, for example, consist of angle rails and serve for accommodating an auxiliary stack support 12, e.g., a board or a rake, are arranged parallel to lateral frames of the sheet delivery mechanism 1. The auxiliary stack support 12 can be horizontally inserted in the inserting direction 13 and retracted opposite to the inserting direction 13. In order to remove sample sheets or to form an auxiliary stack in the delivery stack 5, the delivery mechanism is provided with front holding elements of a known type for holding up the sheets. The holding elements extend over the width of the sheets and can be selectively operated such as by means of blown air or suction air. The front sheet holding elements are arranged such that they protrude into the region of the delivery stack 5 at an acute angle to the horizontal. The front sheet holding elements can be directly moved from a waiting position in the front edge region outside the delivery stack 5 into the stacking region underneath the arriving gripper systems 5 and lowered together with the arriving sheet material 2 in order to form an auxiliary stack.

A crossarm 15 preferably detachably mounted on the frame 24 of the sheet delivery mechanism at both sides, extends at least over the format width of the sheets underneath guides for the auxiliary stack support 12 in the region of the front edge of the delivery stack 5, particularly in the region of the main stack. The delivery mechanism also includes a stack support plate 14 for a pallet 19 which receives sheet material 2 stacked on top of one another. The stack support plate 14 preferably is provided with limit stops 18, wherein the pallet 19 is aligned relative to these limits stops.

In accordance with the invention, at least one edge guide device is provided between the stack support plate and the frame which is variable in length in a vertical direction as an incident to vertical positioning of the support plate. In the illustrative embodiment, two edge guiding devices 16 are arranged in adjacent relation to each other along a front edge of the sheet stack. The edge guiding devices 16 in this case extend between the stack support plate 14 and the crossarm 15. Each edge guiding device 16 is assigned to and located against a front edge 21 of the main stack being formed by the sheet material 2 with edges of the guiding devices being arranged parallel to and separated from the front edge of the stack. The length of each edge guiding device 16 can be varied when the stack support plate 14 is raised or lowered by means of a stack lifting device in order to allow for vertical movement of the stack support plate 14. The change in length of each edge guiding device 16 preferably is synchronized with the vertical movement of the stack support plate 14.

In order to prevent changes in position of the stacked sheet material 2, each edge guiding device 16 is arranged a slight distance 20 from the front edge 21 of the main stack. The distance 20 is chosen such that any friction between the front edge 21 of the sheet material 2 and the edge guiding devices 16 which could impair the position of the sheet material 2 is prevented when the main stack is lowered.

In carrying out one embodiment of the invention, the edge guiding device 16 is a band, preferably maintained under tension, that can be wound up upon itself at one end to shorten the length of the edge guiding device as the stack support plate is moved in an upward vertical direction. Preferably, each edge guiding device 16 includes a winding device 17 that is arranged on the stack support plate. Alternatively, the winding device may be mounted on the crossarm 15. It will be appreciated the winding device 17 may be of a known type which functions to wind and unwind the band material. Alternatively, the edge guiding devices may include at least one cable or a belt that similarly can be wound and unwound under tension.

In a preferred embodiment, the crossarm 15 can be separated from the frame 24 of the sheet delivery mechanism and deposited on the stack support plate 14 securely in position. The band material stored on the winding device 17 is rigidly or detectably connected to the crossarm 15 in this case. When depositing the crossarm 15 on the stack support plate 14, the winding device 17 winds the band material, preferably with the aid of a spring. This also applies to the embodiment in which the edge guiding device 16 or the band material can be separated from a crossarm 15 that remains rigidly connected to the frame.

It will be understood that the invention is not limited to the edge guiding devices 16 being provided along the front edge 21 of the delivery stack 5. On the contrary, a single or multiple arrangement of aligned edge guiding devices 16 can be provided parallel and adjacent to at least one lateral edge and/or the rear edge of the main stack being formed by stacking sheet material 2.

When providing an edge guiding device 16 to the lateral edges and/or the rear edge of the delivery stack 5, the processing of different sheet formats should be taken into consideration. For this purpose, the crossarms 15 and the edge guiding devices 16 are prefeably arranged on the frame of the sheet delivery mechanism or the stack support plate 14 or on the pallet 19 such that they can be adapted to the respective formats. In such case, the winding device 17 for the edge guiding device 16 may be selectively arranged on the stack support plate 14 or on the pallet 19 in the region of the lateral and rear edges or on the crossarm 15.

In another embodiment, the stacked sheets 2 of the main stack can be pivoted in the transport direction 9 from the essentially horizontal stacking plane, such that their front edges are inclined toward an adjacent vertical edge guiding device 16. This pivoting motion of the main stack may be realized, e.g., by pivoting the stack support plate 14 out of the horizontal plane by means of an actuating device that acts upon the stack lifting device, at least while the stack is lowered. For example, the stack support plate 14 can be raised in the vertical direction by a defined amount with tension means of the stack lifting device which only act upon the rear edge of the delivery stack 5. This causes the stack support plate 14 (with the delivery stack 5) to become inclined in the direction of the edge guiding device 16 assigned to the front edge of the delivery stack 5.

In another embodiment, one or more wedges can be placed onto the stack support plate 14 in the region of the rear edge of the delivery stack 5 before the stack is formed. The wedge engages the underside of pallet 19 and thus inclines the pallet 19 in the transport direction 9. This causes the front edge of the delivery stack 5 to become slightly inclined toward the edge guiding device 16. In another embodiment, a tilting device may be arranged on the stack support plate 14 in the region of the rear edge of the delivery stack 5. This tilting device acts upon the pallet 19 in the region of the rear edge by means of an actuating device, for example, a pneumatic or hydraulic actuating device, and causes the delivery stack 5 to become inclined toward the edge guiding device 16. The inclination of the delivery stack 5 must be effected in such a way that guidance along the respective edges takes place in a largely contactless fashion and that possible movement of the edge guiding device 16 from the vertical line due to a contact with the sheet material 2 is prevented.

The invention claimed is:

1. A sheet delivery mechanism for a sheet-fed printing machine comprising an endless conveyor for transporting printed sheet material to a delivery stack formed by stacking said sheet material, a separating device for separating the delivery stack into an auxiliary stack and a main stack, a stack lifting device including a vertically movable stack support plate for supporting the delivery stack, at least one edge guiding device connected to said support plate so as to move vertically together with said support plate and extending in parallel vertical relation adjacent to an edge of the main stack formed by stacking the sheet material, and said edge guiding device having a vertical length that varies depending upon the vertical position of said support plate.

2. The sheet delivery mechanism of claim 1 including at least two said edge guiding devices along a common edge of said main stack.

3. The sheet delivery mechanism of claim 1 in which said edge guiding device is connected in vertically extended fashion between said support plate and a frame of said edge guiding device.

4. The sheet delivery mechanism of claim 1 in which said edge guiding device is connected at one end to a crossarm detachably mounted to said frame.

5. The sheet delivery mechanism of claim 1 in which said edge guiding device includes a flexible material vertically positioned adjacent an edge of said main stack and a winding real for winding said flexible material upon itself during raising movement of said support plate.

6. The sheet delivery mechanism of claim 5 in which said flexible material is a band.

7. The sheet deliver system of claim 1 in which said edge guiding device is arranged in parallel adjacent relation to a front edge of the main stack formed by stacking the sheet material.

8. The sheet delivery mechanism of claim 1 in which said edge guiding device is arranged in parallel adjacent relation to a lateral edge of a main stack formed by the sheet material.

9. The sheet delivery mechanism of claim 1 in which said edge guiding device is arranged in parallel adjacent relation to a rear edge of the main stack formed by stacking the sheet material.

10. The sheet delivery mechanism of claim 1 in which said sheet guiding device changes in length as an incident to vertical movement of the support plate.

11. The sheet delivery mechanism of claim 1 in which the vertical length of said edge guiding device is changeable in synchronism with vertical movement of the stack support plate.

12. The sheet delivery mechanism of claim 1 in which said edge guiding device is arranged a predetermined short distance from the edge of the main stack.

13. The sheet delivery mechanism of claim 1 in which said edge guiding device includes a tensioned band material that is wound upon itself to shorten its length upon raising movement of said support plate.

14. The sheet delivery mechanism of claim 1 in which said edge guiding device includes a winding device mounted on the stack for winding the edge guiding device to change its length.

15. The sheet delivery mechanism of claim 14 in which said winding device is removably mounted on said stack support plate.

16. The sheet delivery mechanism of claim 1 in which said main stack of sheet material is supported by said support plate in inclined relation to the horizontal toward an adjacent edge guiding device.

* * * * *